US008182054B2

(12) United States Patent
Liang et al.

(10) Patent No.: US 8,182,054 B2
(45) Date of Patent: May 22, 2012

(54) RETRACTION MECHANISM FOR A DRAWER

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 497 days.

(21) Appl. No.: 12/385,681

(22) Filed: Apr. 16, 2009

(65) Prior Publication Data

US 2009/0278430 A1 Nov. 12, 2009

(30) Foreign Application Priority Data

May 7, 2008 (TW) ..... 97116924 A

(51) Int. Cl.
*A47B 95/00* (2006.01)
*A47B 95/02* (2006.01)

(52) U.S. Cl. ..... 312/333; 312/319.1

(58) Field of Classification Search ..... 312/333, 312/319.1–319.2, 334.44, 334.46–334.47; 384/21

See application file for complete search history.

(56) References Cited

U.S. PATENT DOCUMENTS 5,088,839 A * 2/1992 Tsukada ..... 384/45
5,207,781 A 5/1993 Rock
5,240,318 A 8/1993 Schroder et al.
5,302,016 A 4/1994 Lautenschlager et al.
5,364,179 A 11/1994 Brustle et al.
5,474,375 A 12/1995 Hollenstein et al.
5,580,138 A 12/1996 Grabher
6,672,692 B2 * 1/2004 Weng ..... 312/333
6,846,053 B2 * 1/2005 Salice ..... 312/334.14
6,953,233 B2 * 10/2005 Lam et al. ..... 312/333
7,040,725 B1 * 5/2006 Mao-Chin ..... 312/334.44
7,077,487 B2 * 7/2006 Yang ..... 312/333
7,244,005 B1 * 7/2007 Lu ..... 312/333
7,249,813 B2 7/2007 Gasser
7,441,848 B2 10/2008 Chen et al.
7,481,505 B2 * 1/2009 Orita ..... 312/333
2004/0227438 A1 11/2004 Tseng et al.
2005/0093406 A1 * 5/2005 Yang ..... 312/333
2006/0082266 A1 * 4/2006 Le et al. ..... 312/319.1
(Continued)

FOREIGN PATENT DOCUMENTS

EP 2201863 A1 * 6/2010

*Primary Examiner* — Darnell Jayne
*Assistant Examiner* — Andrew Roersma
(74) *Attorney, Agent, or Firm* — Rosenberg, Klein & Lee

(57) ABSTRACT

A retraction mechanism for a drawer includes a guiding member, a holding member, and an elastic member. The guiding member includes a first wall, a second wall, a first channel and a second channel, a first end portion extending from first ends of the first and second walls. The first end portion includes a locking portion adjacent to the first channel. The holding member includes a pin slot, and a first supporting portion and a second supporting portion to hold against the first and second channels, respectively. The first supporting portion includes a first supporting leg corresponding to the locking portion. The drawer includes a pin for engaging with or disengaging from the pin slot when the drawer is pulled or pushed. The elastic member is adapted to act on the holding member. The drawer urged by the elastic member will be retracted into a furniture body when the drawer is moved to a predetermined position.

27 Claims, 15 Drawing Sheets

U.S. PATENT DOCUMENTS

2007/0132346 A1* 6/2007 Huang ..... 312/333
2007/0278919 A1* 12/2007 Lu ..... 312/333
2008/0008407 A1* 1/2008 Takamiya et al. ..... 384/45
2008/0197759 A1 8/2008 Chen et al.
2008/0303396 A1* 12/2008 Yoon et al. ..... 312/334.44
2009/0121596 A1* 5/2009 Ferrari ..... 312/334.8
2009/0160299 A1* 6/2009 Chen et al. ..... 312/334.44
2009/0195131 A1* 8/2009 Chi et al. ..... 312/319.1

* cited by examiner

RETRACTION MECHANISM FOR A DRAWER

BACKGROUND OF THE INVENTION

1. Field of the Invention

The present invention relates to a retraction mechanism, and more particularly to a retraction mechanism adapted to a drawer to assist the drawer in retracting into a furniture body.

2. Description of Prior Art

Retractable drawers have been widely used by the consumers, and there are a number of patents related to this issue, such as U.S. Pat. No. 5,207,781 to Rock, titled "Closing device for moving a drawer to a fully inserted position within a furniture body"; U.S. Pat. No. 5,364,179 to Brustle et al, titled "Closing device for Drawers"; U.S. Pat. No. 5,474,375 to Hollenstein et al, titled "Closing device for moving a drawer to a fully inserted position within a furniture body"; U.S. Pat. No. 5,240,318 to Schroder et al, titled "Device for holding a drawer in an article of furniture"; U.S. Pat. No. 5,302,016 to Lautenschlager et al, titled "Automatic pull-in mechanism for drawer guides"; U.S. Pat. No. 5,580,138 to Grabher, titled "Retraction-assisting device for use with a drawer; and U.S. Pat. No. 7,249,813 to Gasser, titled "Retraction device for drawers".

U.S. Pat. No. 5,207,781 discloses a pin member linking a tiltable member along a groove. One end of the tiltable member is pulled by an elastic member, and the terminal of the groove is formed with a curved end. When the tiltable member driven by the pin member is moved to the curved end of the groove, the tiltable member will be turned at a predetermined angle to engage with the curved end temporarily, which allows the drawer to be moved outward freely from a cabinet. To retract the drawer, simply push the drawer inward, which brings the pin member to reconnect with the tiltable member. With the elasticity of the elastic member, the drawer is fully retracted into the cabinet.

All of the other patents described above share the same concept of using a groove or the like for the tiltable member to move therealong. Without the groove, the tilting movement will be unstable. In order to stabilize the movement, it is necessary to increase the size of the groove. Furthermore, the prior art uses the cured groove to lock the tiltable member, which may be disengaged with a minor movement. The tiltable member may be pulled back by the elastic member.

SUMMARY OF THE INVENTION

The present invention relates to a retraction mechanism for a drawer, which provides a simple and easy way for installation of the retraction mechanism and facilitates retraction of a drawer back into a furniture body steadily.

According to a first aspect of the present invention, there is provided a retraction mechanism for a drawer, comprising at least one stationary rail, a furniture body, at least one drawer, and at least one drawer rail mounted to the drawer, the stationary rail being mounted to the furniture body and the drawer rail being slidably connected to the stationary rail, the retraction mechanism comprising:

a guiding member secured to the stationary rail, the guiding member comprising a first wall, a second wall, a third wall extending from the first wall, a first channel defined between the first wall and the third wall, a fourth wall extending from the second wall, a second channel defined between the second wall and the fourth wall, and a first end portion extending from first ends of the first wall and the second wall, the first end portion comprising a locking portion adjacent to the first channel;

a holding member comprising a first supporting portion holding against the first channel and a second supporting portion extending from the first supporting portion, the first supporting portion comprising a first supporting leg corresponding to the locking portion of the guiding member, a second supporting leg, and a recess defined between the first supporting leg and the second supporting leg, the second supporting portion comprising a supporting plate holding against the fourth wall of the guiding member and a third supporting leg holding against the second channel of the guiding member, the recess providing a space for the holding member to tilt at a predetermined angle and the first supporting leg engaging with the locking portion of the guiding member, the holding member further comprising a first holding wall, a second holding wall, and a pin slot defined between the first holding wall and the second holding wall; and an elastic member having a first end connected to the holding member and a second end secured to the stationary rail, the elastic member providing a pulling force to the holding member;

the drawer comprising a pin corresponding in position to the pin slot, when the drawer is retracted into the furniture body, the pin of the drawer engaging with the pin slot of the holding member, the elastic member urging the holding member toward the second end of the elastic member, when the drawer is pulled outwardly to a first predetermined position, the pin holding against the first holding wall of the holding member for the holding member to tilt at an angle, the first supporting leg of the first supporting portion of the holding member disengaging from the first channel of the guiding member with the first supporting leg holding against the locking portion of the guiding member, the pin disengaging from the pin slot of the holding member, and the drawer being free from the elastic member;

when the drawer is moved towards the furniture body to a second predetermined position, the pin of the drawer holding against the second holding wall of the holding member for the holding member to tilt at an angle which brings the first supporting leg of the holding member to disengage from the locking portion of the guiding member, the holding member being pulled by the elastic member to retract the drawer into the furniture body.

According to a second aspect of the present invention, there is provided a retraction mechanism for a drawer, comprising at least one stationary rail, a furniture body, at least one drawer, and at least one drawer rail mounted to the drawer, the stationary rail being mounted to the furniture body and the drawer rail being slidably connected to the stationary rail, the retraction mechanism comprising:

a guiding member secured to the stationary rail, the guiding member comprising a first wall, a second wall, a third wall extending from the first wall, a first channel defined between the first wall and the third wall, a fourth wall extending from the second wall, a second channel defined between the second wall and the fourth wall, and a first end portion extending from first ends of the first wall and the second wall, the first end portion comprising a locking portion adjacent to the first channel;

a holding member comprising a first supporting portion holding against the first channel and a second supporting portion extending from the first supporting portion, the first supporting portion comprising a first supporting leg corresponding to the locking portion of the guiding member, a second supporting leg, and a recess defined between the first supporting leg and the second supporting leg, the second supporting portion comprising a supporting plate holding against the fourth wall of the guiding member and a third supporting leg holding against the second channel of the guiding member, the recess providing a space for the holding member to tilt at a predetermined angle and the first supporting leg engaging with the locking portion of the guiding member, the holding member further comprising a first holding wall, a second holding wall, and a pin slot defined between the first holding wall and the second holding wall, the drawer comprising a pin corresponding in position to the pin slot, the first holding wall and the second holding wall being substantially perpendicular to the first wall of the guiding member, a length from a top of the first holding wall to a bottom of the pin slot being shorter than a length from a bottom of the first supporting leg to a top of the recess; and an elastic member having a first end connected to the holding member and a second end secured to the stationary rail, the elastic member providing a pulling force to the holding member.

DETAILED DESCRIPTION OF THE PREFERRED EMBODIMENTS

Figure 1:
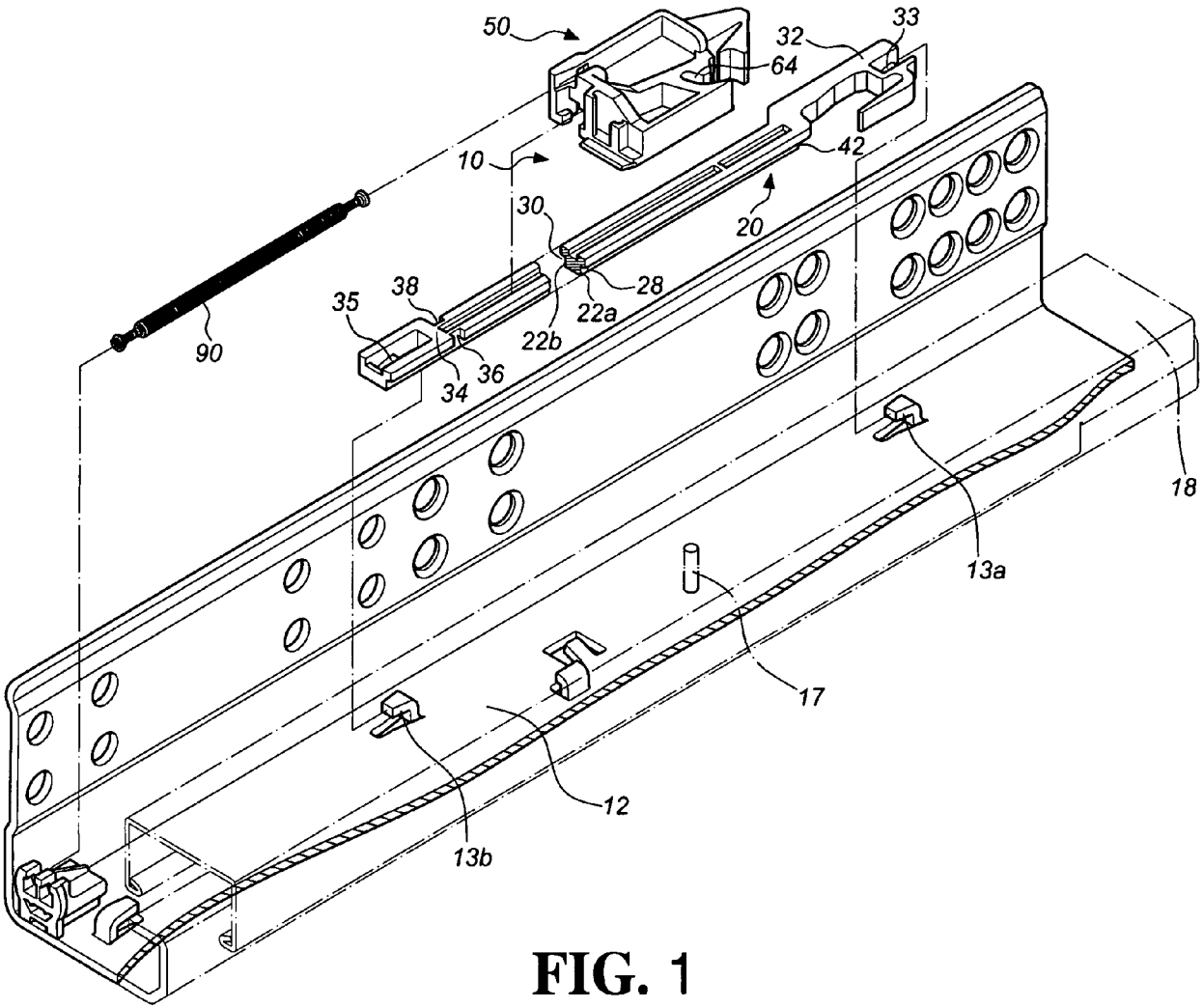
FIG. 1 is an exploded view of a retraction mechanism and a stationary rail according to a first preferred embodiment of the present invention.
Figure 2:
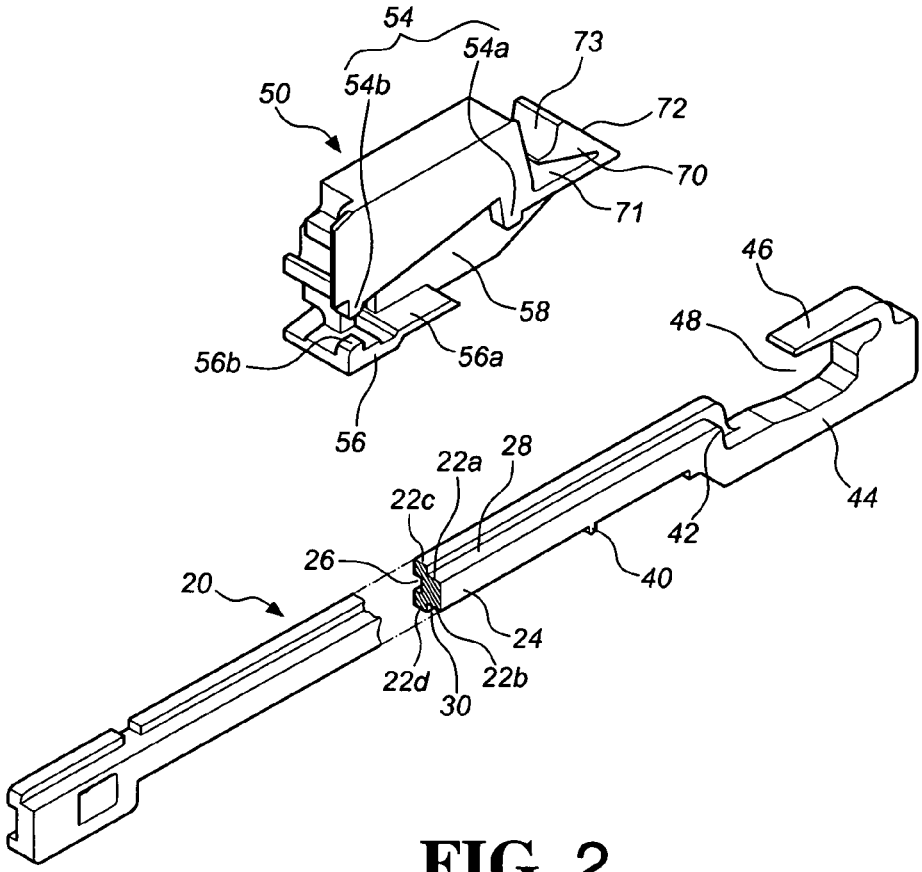
FIG. 2 is an exploded view of the retraction mechanism according to the first preferred embodiment of the present invention.
Figure 3:
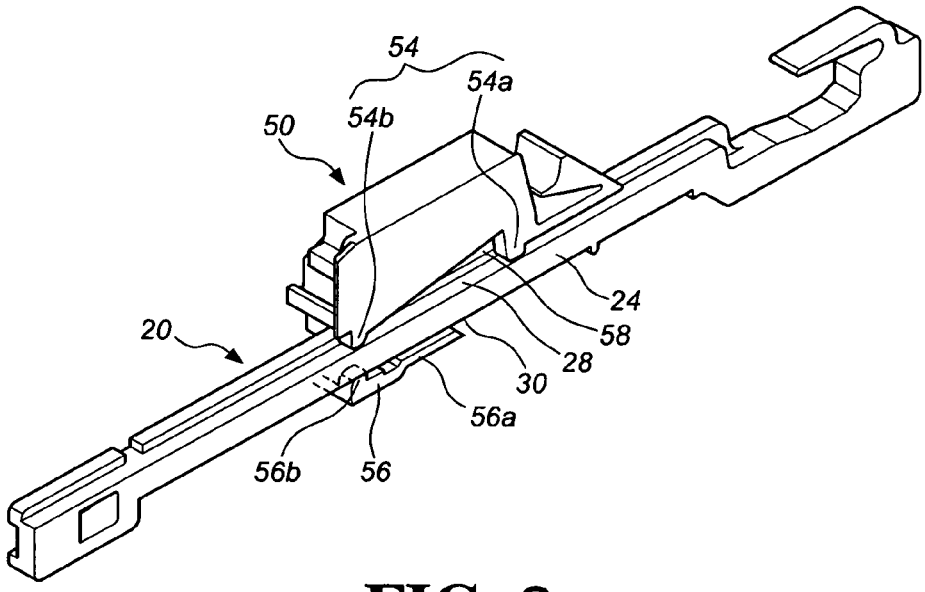
FIG. 3 is a perspective view of the retraction mechanism according to the first preferred embodiment of the present invention.

FIG. 1 is an exploded view of a retraction mechanism 10 and a stationary rail 12 according to a first preferred embodiment of the present invention. FIGS. 2 through 5 are schematic views of the retraction mechanism 10. As shown in FIGS. 1 through 5, the retraction mechanism 10 comprises a guiding member 20, a holding member 50 and an elastic member 90.

The guiding member 20 is secured to the stationary rail 12. The guiding member 20 comprises a first wall 22*a*, a second wall 22*b*, a side wall 24, a third wall 22*c*, and a fourth wall 22*d*. The side wall 24 is disposed between the first wall 22*a* and the second wall 22*b*. A groove 26 is defined among the side wall 24, the first wall 22*a*, and the second wall 22*b*. The third wall 22*c* extends from a portion of a surface of the first wall 22*a*. A first channel 28 is defined between the first wall 22*a* and the third wall 22*c*. The fourth wall 22*d* extends from a portion of a surface of the second wall 22*b*. A second channel 30 is defined between the second wall 22*b* and the fourth wall 22*d*. A first end portion 32 and a second end portion 34 extend from two opposite ends of the first wall 22*a* and the second wall 22*b*, respectively. A first notch 36 is formed between the second end portion 34 and the third wall 22*c*. A second notch 38 is formed between the second end portion 34 and the fourth wall 22*d*. The first end portion 32 comprises a locking portion 42 adjacent to one end of the first channel 28, a first extension plate 44 extending from the first wall 22*a* and the second wall 22*b*, a second extension plate 46 extending from the first extension plate 44 inwardly, and a clip slot 48 defined between the first extension plate 44 and the second extension plate 46. In this embodiment, the first end portion 32 and the second end portion 34 of the guiding member 20 comprise a first fixing portion 33 and a second fixing portion 35, respectively. The stationary rail 12 comprises a first engaging portion 13*a* and a second engaging portion 13*b* to engage with the first fixing portion 33 and the second fixing portion 35, respectively, as shown in FIG. 5.

Figure 4:
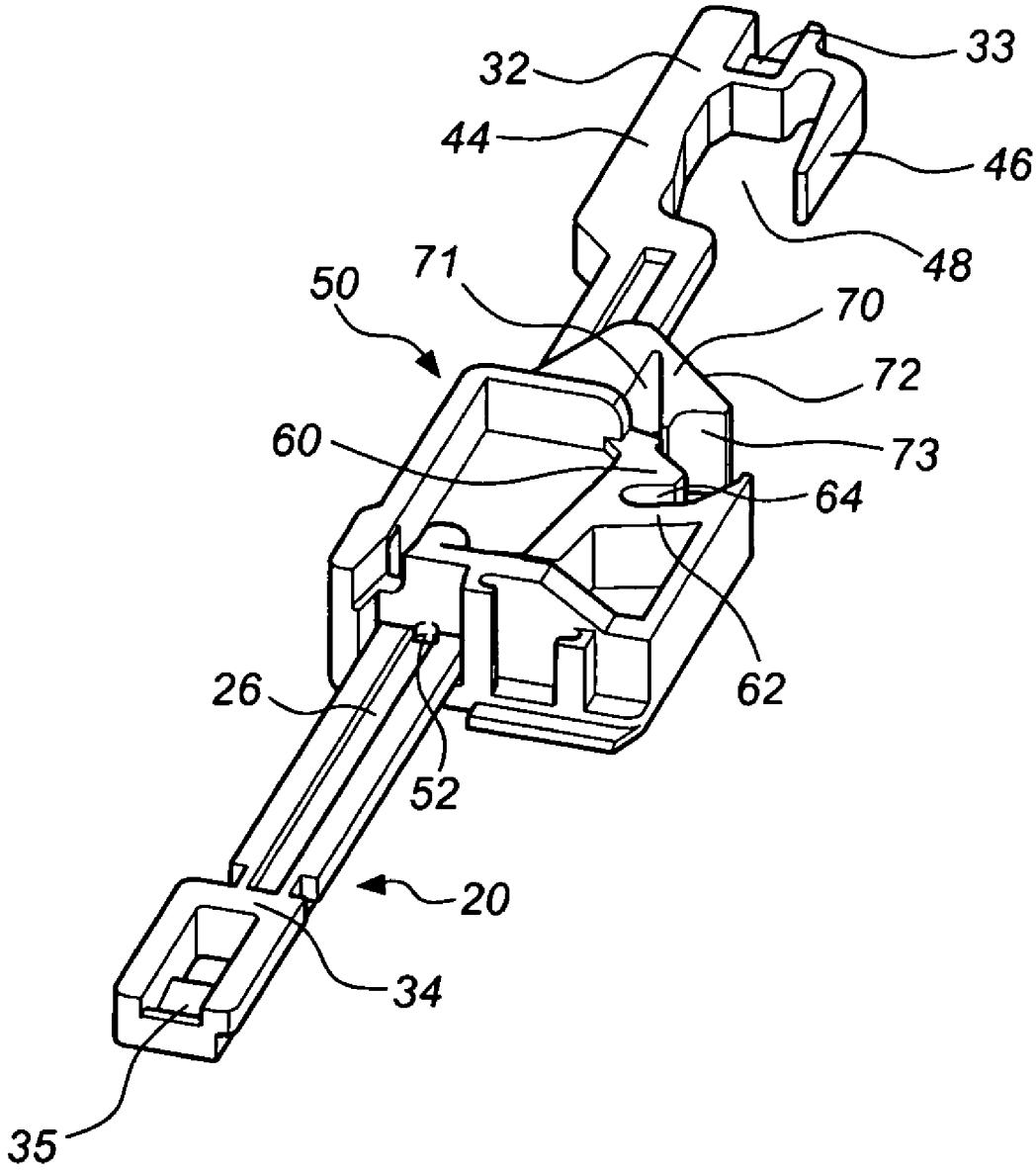
FIG. 4 is another perspective view of the retraction mechanism according to the first preferred embodiment of the present invention.

The holding member 50 comprises a holding portion 52, a first supporting portion 54, and a second supporting portion 56. The holding portion 52 is coupled to the groove 26 of the guiding member 20, as shown in FIG. 4. The first supporting portion 54 rests on the first channel 28 of the guiding member 20. The second supporting portion 56 extends from the first supporting portion 54. The first supporting portion 54 further comprises a first supporting leg 54*a* corresponding to the locking portion 42 of the guiding member 20, a second supporting leg 54*b*, and a recess 58 defined between the second supporting leg 54*b* and the first supporting leg 54*a*. The recess 58 allows the holding member 50 to make a movement at a predetermined angle. The second supporting portion 56 comprises a supporting plate 56*a* holding against the fourth wall 22*d* of the guiding member 20, and a third supporting leg 56*b* holding against the second channel 30 of the guiding member 20. The second channel 30 is provided with a protrusion 40.

The holding member 50 further comprises a first holding wall 60 and a second holding wall 62, and a pin slot 64 defined between the first holding wall 60 and the second holding wall 62. The pin slot 64 is located corresponding to a pin 17 of a drawer rail 18. The first holding wall 60 and the second holding wall 62 are substantially perpendicular to the first wall 22*a* of the guiding member 20. The length from a top of the first holding wall 60 to a bottom of the pin slot 64 is shorter than the length from a top of the first supporting leg 54*a* to a bottom of the recess 58. The holding member 50 has a first end and a second end. A head portion 70 extends from the first end of the holding member 50. The head portion 70 corresponds in position to the clip slot 48 of the guiding member 20. A buffer slot 71 is defined between the head portion 70 and the holding member 50. The head portion 70 has an inclined plane 72 corresponding to the second extension plate 46 and a stop surface 73 adjacent to the inclined plane 72 to form an acute angle thereat.

Figure 5:
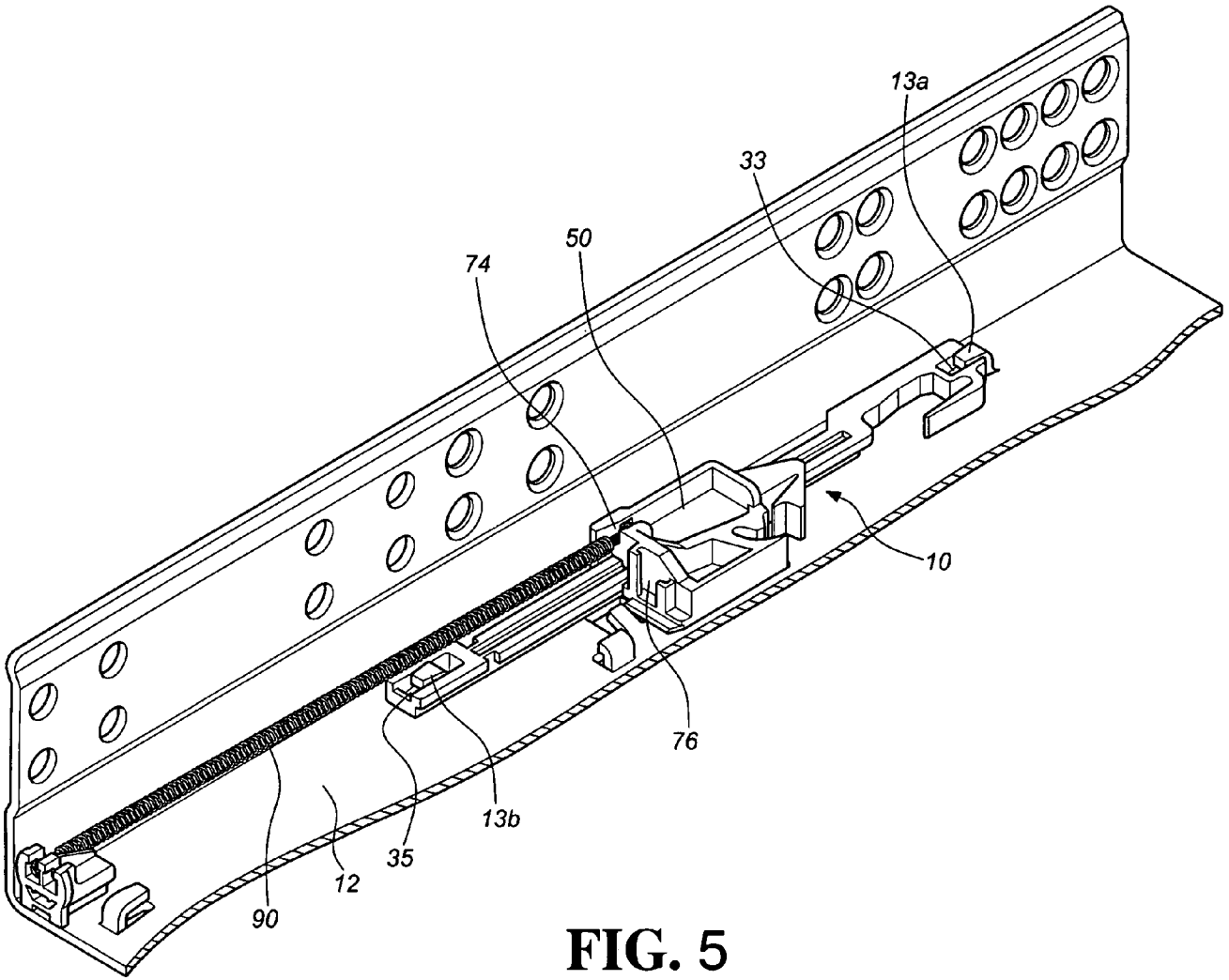
FIG. 5 is a perspective view of the retraction mechanism and the stationary rail according to the first preferred embodiment of the present invention.

The elastic member 90 has a first end connected to the holding member 50 and a second end fixed to the stationary rail 12, providing an urging force to pull the holding member 50 backwardly, as shown in FIG. 5.

Figure 7:
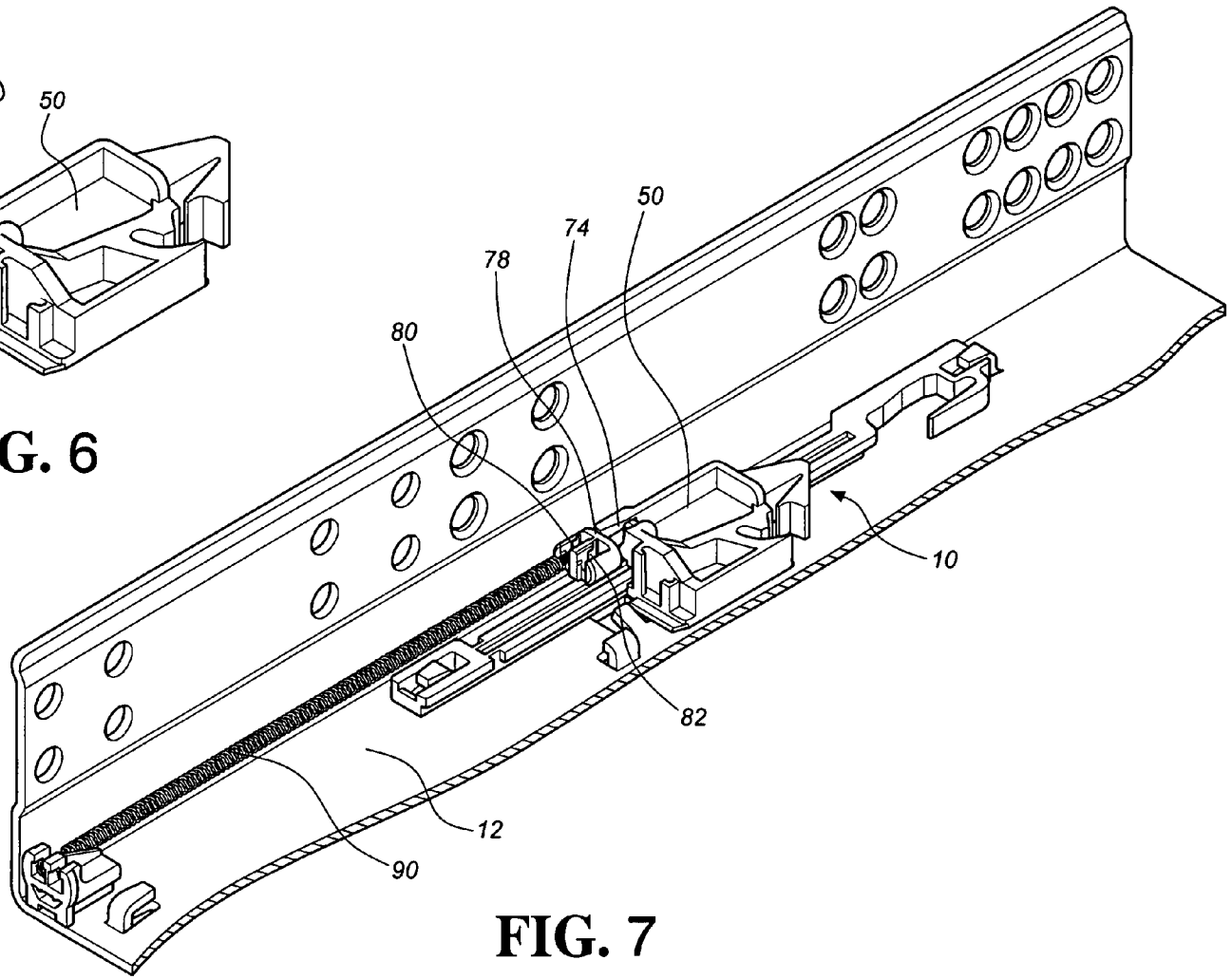
FIG. 7 is a perspective view of the retraction mechanism connected the connecting member and the stationary rail according to the first preferred embodiment of the present invention.
Figure 6:
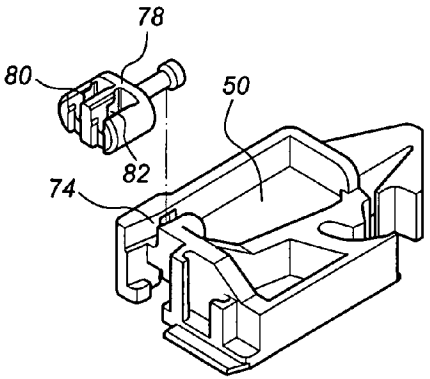
FIG. 6 is an exploded view of the retraction mechanism provided with a connecting member according to the first preferred embodiment of the present invention.

FIG. 5 is a perspective view of the retraction mechanism 10 and the stationary rail 12 according to the first preferred embodiment of the present invention. The elastic member 90 of the retraction mechanism 10 directly acts on the holding member 50. The second end of the holding member 50 may be provided with a first connecting seat 74 and a second connecting seat 76. In this embodiment, a connecting member 78 is secured to the first connecting seat 74. As shown in FIGS. 6 and 7, the connecting member 78 comprises a pair of connecting portions 80 and 82 for a pair of elastic members to be secured thereat. In this embodiment, the first end of the elastic member 90 is connected to either of the connecting portions 80 and 82 for the elastic member 90 of the retraction mechanism 10 to act on the holding member 50.

Figure 8:
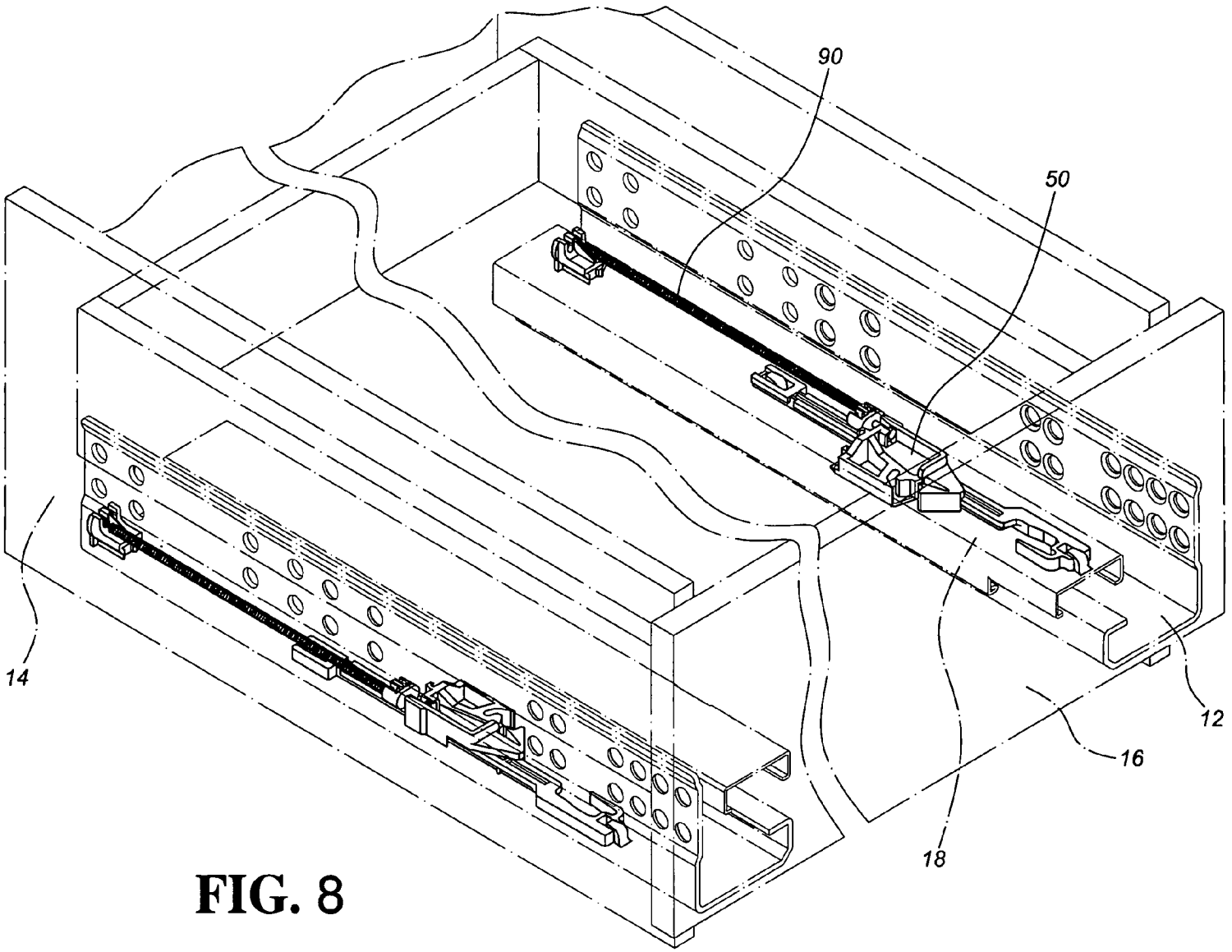
FIG. 8 is a schematic view of the retraction mechanism in conjunction with a drawer and a furniture body according to the first preferred embodiment of the present invention.
Figure 9:
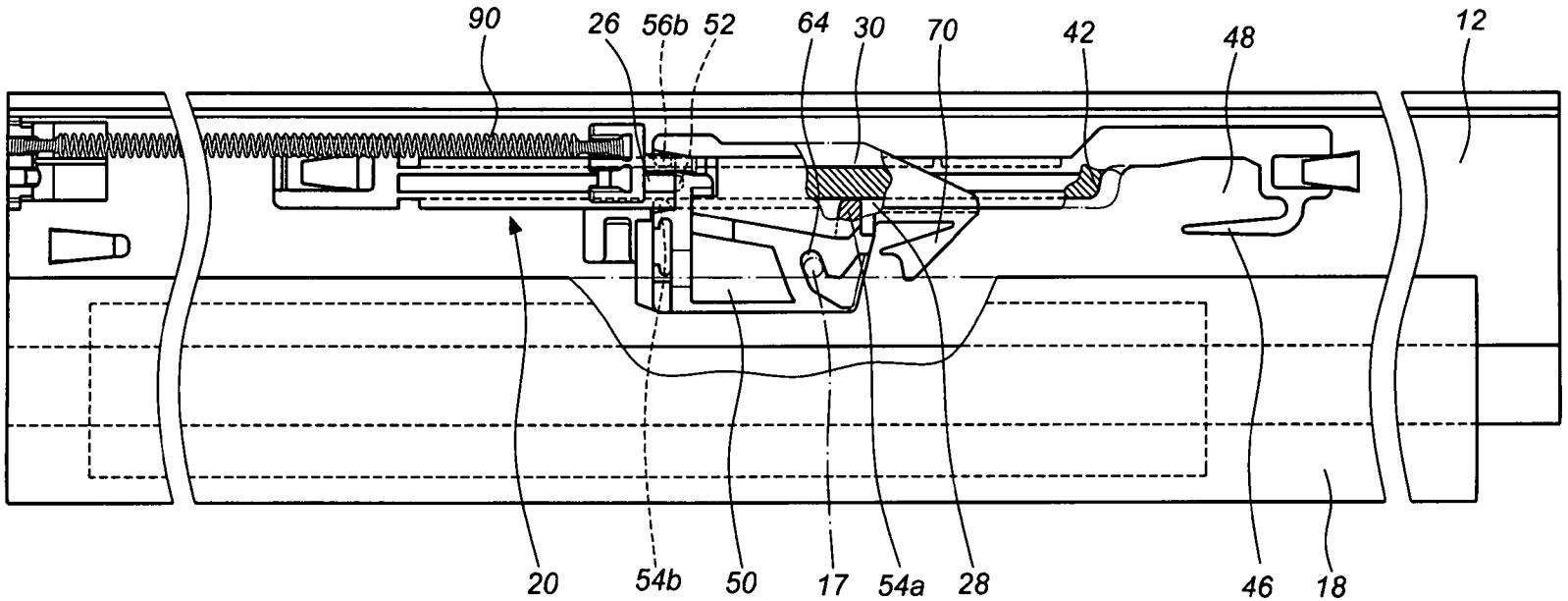
FIG. 9 is a cross-sectional view of the retraction mechanism and the stationary rail according to the first preferred embodiment of the present invention.

FIGS. 8 and 9 show the operation of the present invention. This embodiment comprises a plurality of furniture accessories, such as at least one pair of stationary rails 12, a furniture body 14, at least one drawer 16, and at least one pair of drawer rails 18 secured to the drawer 16. The pair of stationary rails 12 is secured to the furniture body 14. The pair of drawer rails 18 is slidably connected to the pair of stationary rails 12, so that the drawer 16 may be slidable in the furniture body 14. The drawer 16 comprises the pin 17 corresponding in position to the pin slot 64 of the holding member 50. When the drawer 16 is fully retracted into the furniture body 14, the pin 17 of the drawer 16 will rest in the pin slot 64 of the holding member 50 and the elastic member 90 will urge the holding member 50 towards the second end of the elastic member 90 which is fixed to the stationary rail 12, thus the drawer 16 remains in the furniture body 14.

Figure 10:
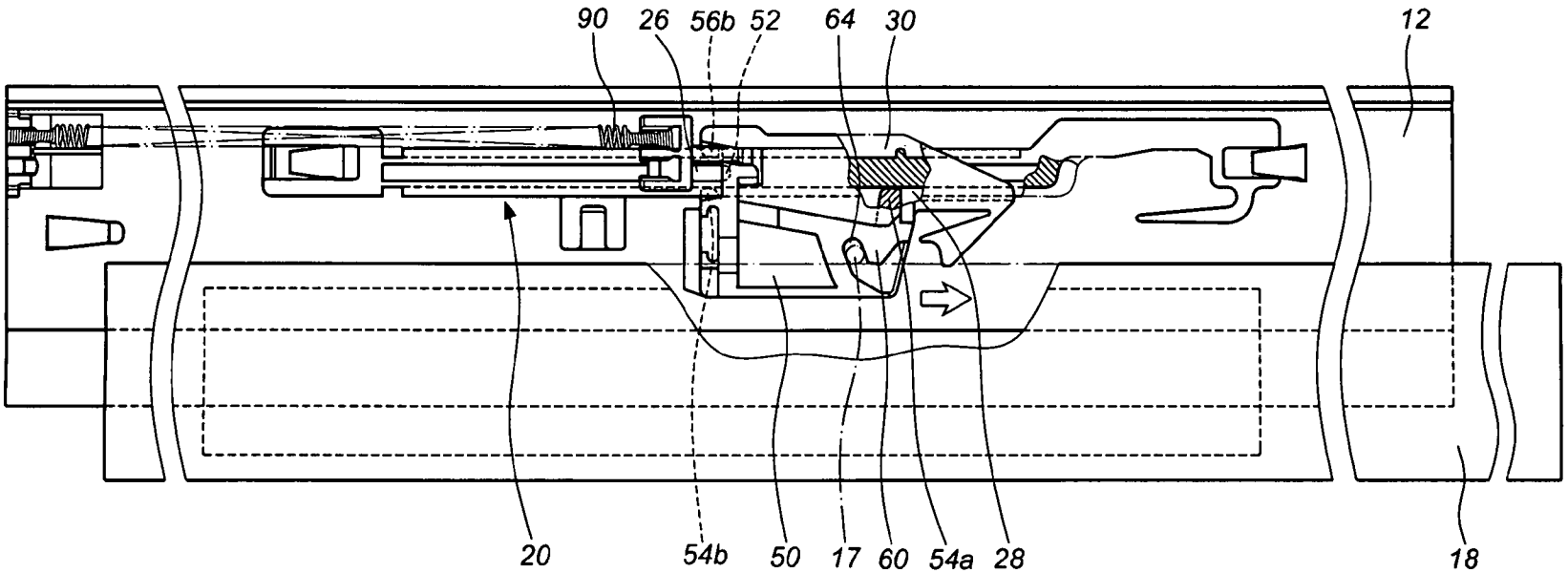
FIG. 10 is a cross-sectional view showing a holding member of the retraction mechanism being pulled to a predetermined position according to the first preferred embodiment of the present invention.

When the drawer 16 is pulled away from the furniture body 14, as shown in FIG. 10, the urging force from the elastic member 90 must be overcome. The pin 17 resting in the pin slot 64 is engaged with the first holding wall 60 so that the holding member 50 slides along with the movement of the drawer 16. The holding portion 52 of the holding member 50 slides along the groove 26 of the guiding member 20. The first supporting leg 54*a* and the second supporting leg 54*b* of the holding member 50 slide along the first channel 28 while the third supporting leg 56*b* of the holding member 50 slides along the second channel 30 of the guiding member 20.

Figure 11:
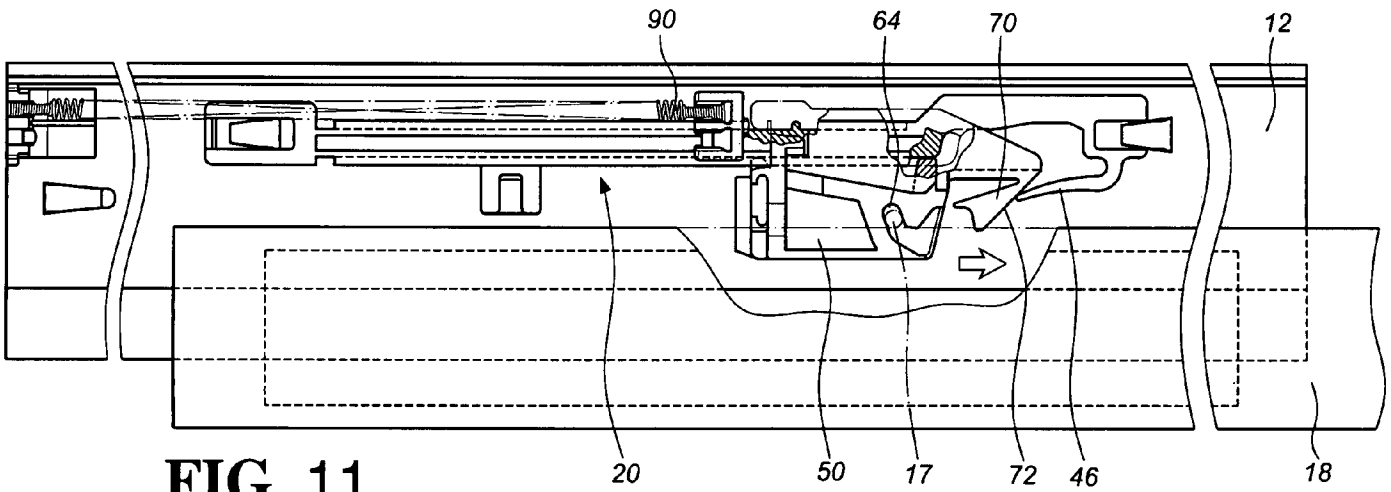
FIG. 11 is a cross-sectional view showing a second extension plate of a guiding member being held according to the first preferred embodiment of the present invention.
Figure 12:
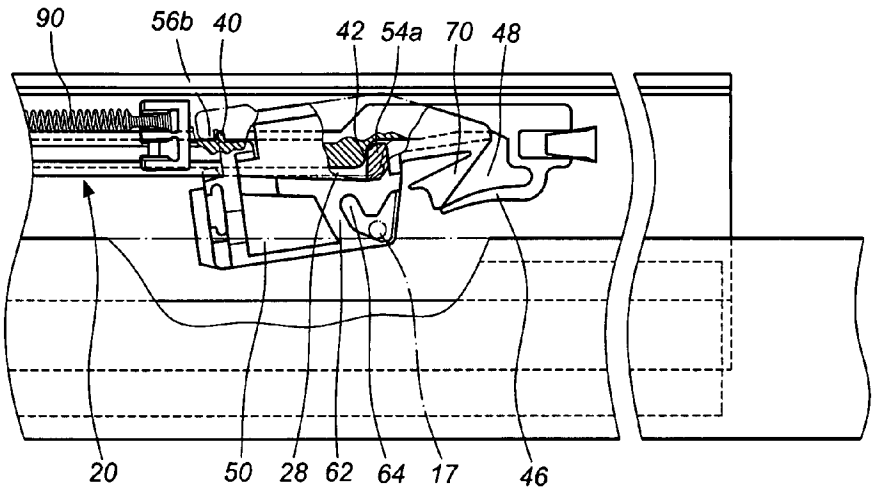
FIG. 12 is a cross-sectional view showing the holding member being locked according to the first preferred embodiment of the present invention.
Figure 13:
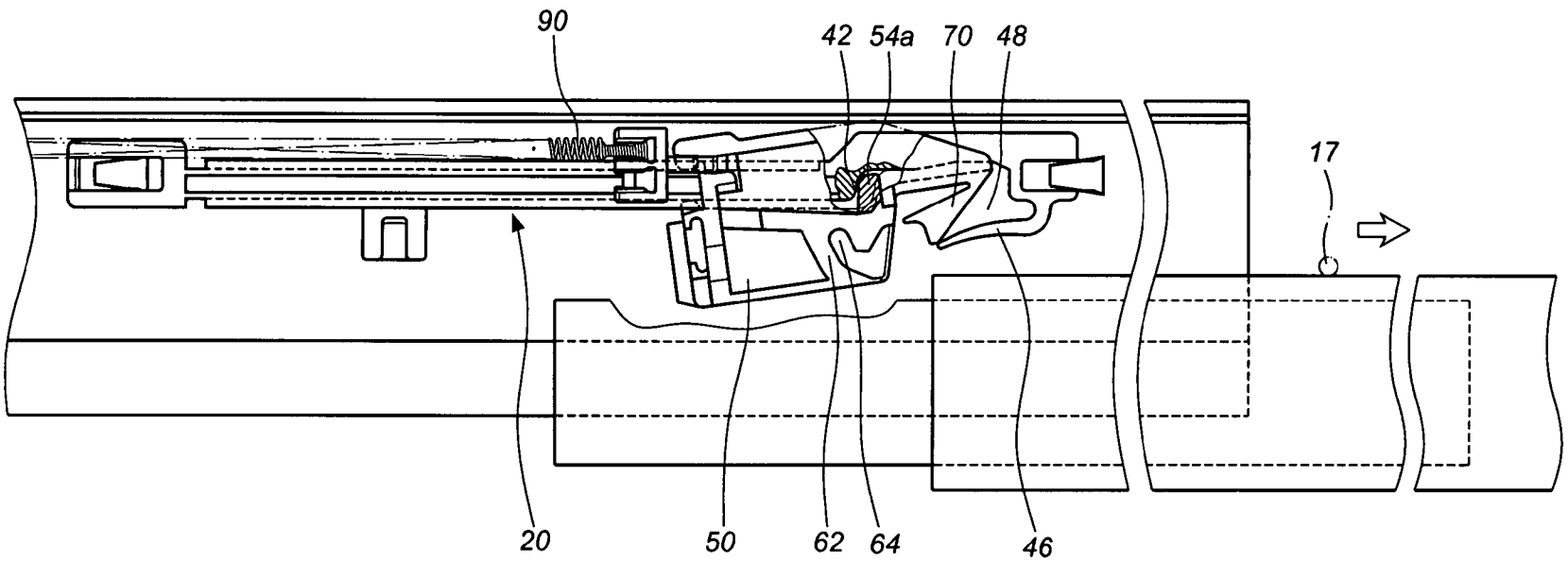
FIG. 13 is a cross-sectional view showing detachment of a pin of the drawer from the retraction mechanism according to the first preferred embodiment of the present invention.

When the drawer 16 is pulled to a first predetermined position, as shown in FIG. 11, the inclined plane 72 of the head portion 70 of the holding member 50 will engage with the second extension plate 46 of the guiding member 20 and the second extension plate 46 will be elastically bent, as shown in FIG. 12. The first supporting leg 54*a* of the holding member 50 disengages from the first channel 28 of the guiding member 20, so that the holding member 50 is able to tilt at an angle which brings the first supporting leg 54*a* to hold against the locking portion 42 of the guiding member 20, while the third supporting leg 56*b* of the second supporting portion 56 holds against the protrusion 40 of the guiding member 20 for restricting movement of the holding member 50. The second extension plate 46 of the guiding member 20 engages with the head portion 70 of the holding member 50 to keep the head portion 70 of the holding member 50 within the clip slot 48 of the guiding member 20. The elastic member 90 provides a backward pulling force to the holding member 50 for keeping the holding member 50 in a locked status. The pin 17 of the drawer 16 may be disengaged from the pin slot 64 of the holding member 50, thus the drawer 16 may be pulled outward freely, as shown in FIG. 13.

On the other hand, when the drawer 16 is pushed to a second predetermined position toward the furniture body 14, the pin 17 will hold against the second holding wall 62 of the holding member 50 to move, and the holding member 50 will be able to tilt at an angle to bring the first supporting leg 54*a* of the holding member 50 to disengage from the locking portion 42 of the guiding member 20. The third supporting leg 56*b* is brought to disengage from the protrusion 40 of the guiding member 20, and the head portion 70 of the holding member 50 is brought to disengage from the clip slot 48 of the guiding member 20, so that the first supporting leg 54*a* of the holding member 50 holds against the first channel 28 of the guiding member 20. The holding member 50 is pulled by the elastic member 90, so that the drawer 16 urged by the elastic member 90 is fully retracted into the furniture body 14, as shown in FIG. 9.

Figure 14:
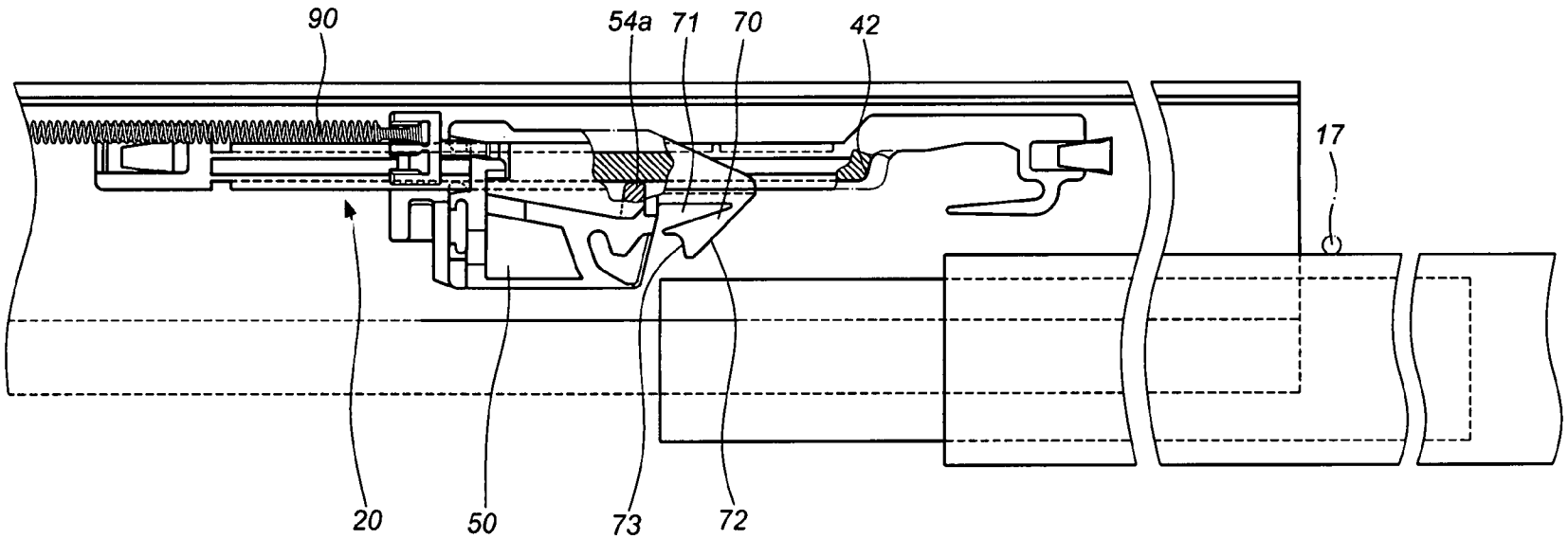
FIG. 14 is a cross-sectional view showing the holding member malfunctioning and being pulled back according to the first preferred embodiment of the present invention.
Figure 15:
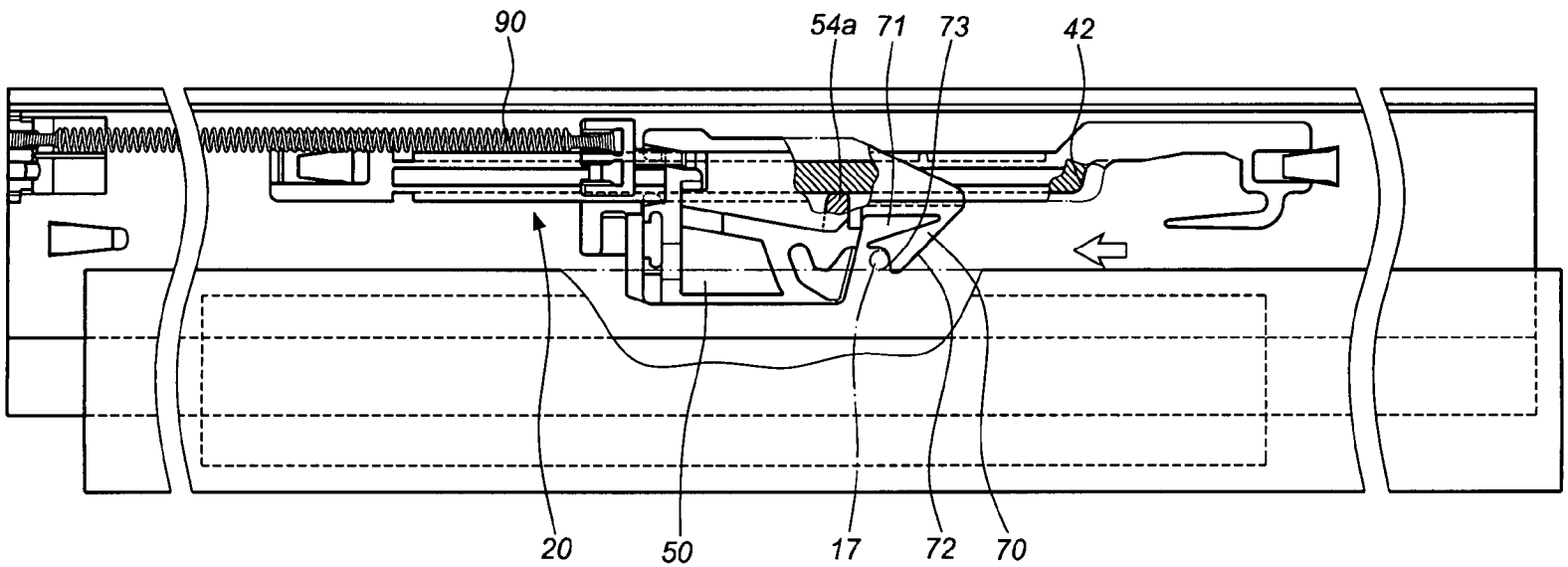
FIG. 15 is a cross-sectional view showing the pin being engaged with the holding member again according to the first preferred embodiment of the present invention.

In the event of a malfunction situation, as shown in FIG. 14, when the drawer 16 is pulled away from the furniture body 14 which links the holding member 50 to move, if the first supporting leg 54*a* is not engaged with the locking portion 42, no matter for what reasons, the holding member 50 will be pulled by the elastic member 90 to a predetermined position. Hence, to restore to a normal position, the drawer 16 may be pushed into the furniture body 14 to bring the pin 17 of the drawer 16 holding against the holding member 50, thus when the pushing force from the elastic member 90 is continued on the drawer 16 towards the furniture body 14, the pin 17 of the drawer 16 will slide along the inclined plane 72 of the head portion 70 which pushes the head portion 70 towards the buffer slot 71, therefore the pin 17 of the drawer 16 overrides the inclined plane 72 of the head portion 70 to engage with the stop surface 73, thus the operation is back to normal status and the holding member 50 can be moved by the pin 17 of the drawer 16.

Figures 16, 17:
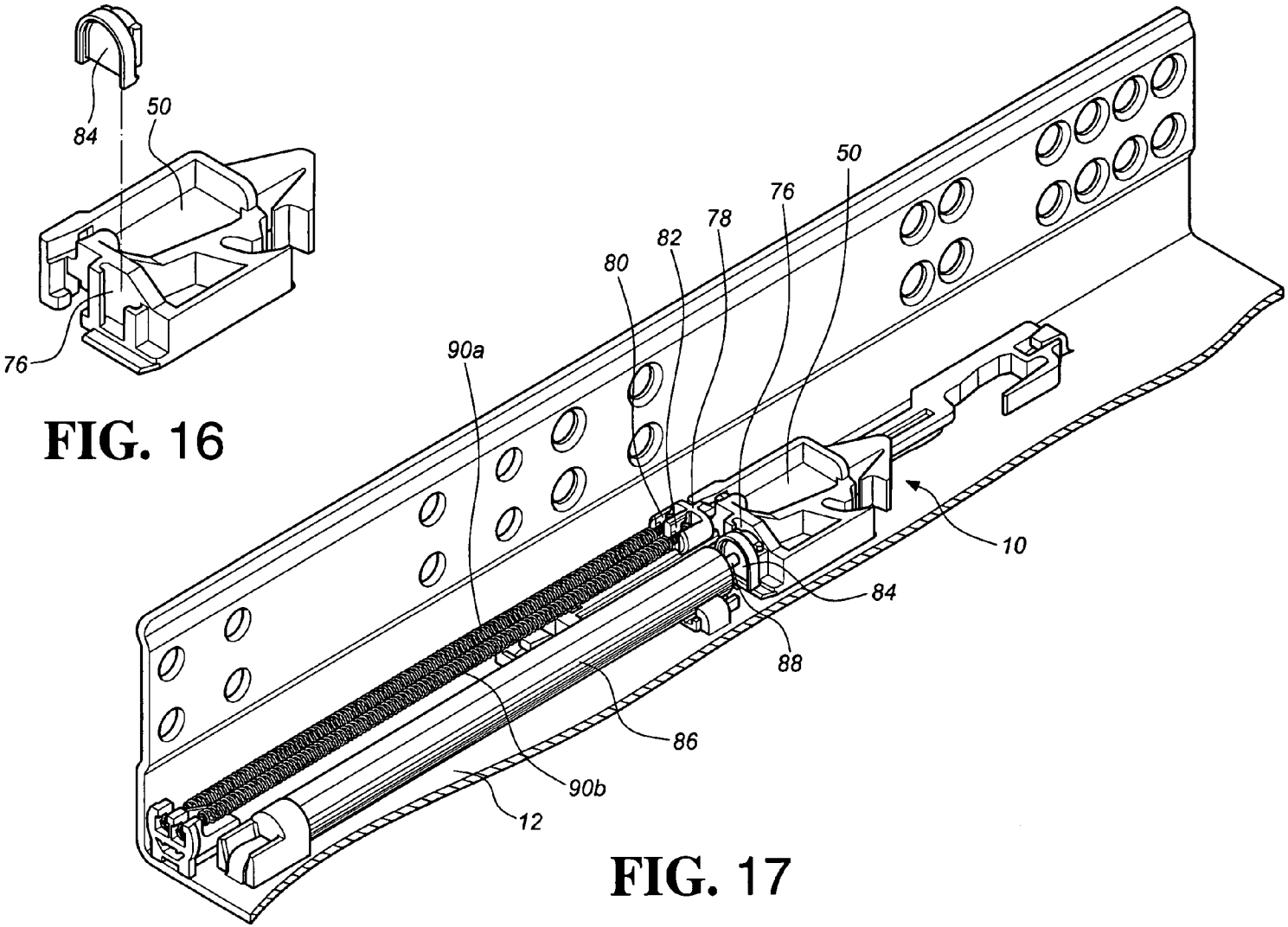
FIG. 16 is an exploded view of the retraction mechanism provided with a pad according to a second preferred embodiment of the present invention.
FIG. 17 is a perspective view of the retraction mechanism provided with the pad and the stationary rail according to the second preferred embodiment of the present invention.
Figure 18:
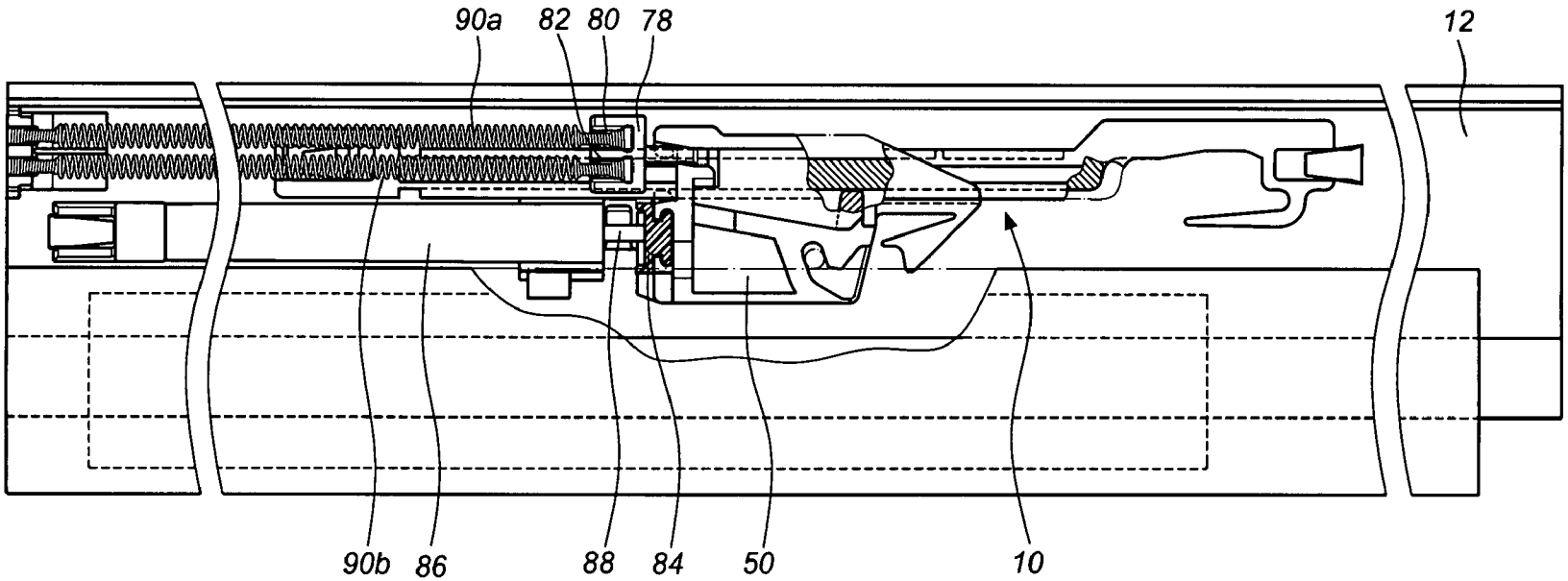
FIG. 18 is a cross-sectional view of the retraction mechanism and the stationary rail according to the second preferred embodiment of the present invention.

FIG. 16 is an exploded view according to a second preferred embodiment of the present invention, which is substantially similar to the first preferred embodiment with the exception described hereinafter. The retraction mechanism further comprises a pad 84, a pair of elastic members 90*a* and 90*b*, and a buffer member 86. The pad 84 is secured to the second connecting seat 76 of the holding member 50, as shown in FIGS. 17 and 18. In this embodiment, the pair of elastic members 90*a* and 90*b* has first ends connected to the connecting portions 80 and 82 of the connecting member 78 and second ends secured to the stationary rail 12. The buffer member 86 has a first end secured to the stationary rail 12 and a second end provided with a telescopic inner rod 88 which is connected to the pad 84 for providing a buffering against the holding member 50.

Figure 19:
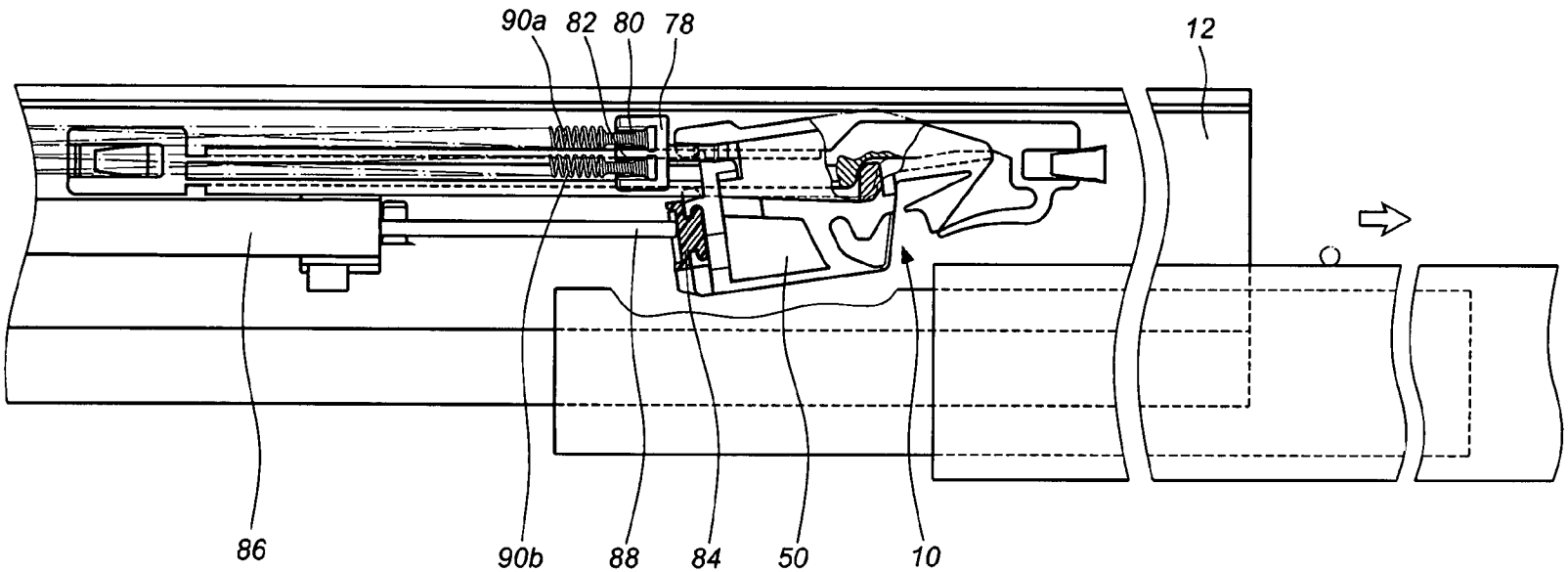
FIG. 19 a cross-sectional view showing the holding member being locked according to the second preferred embodiment of the present invention.

The operation of the second preferred embodiment is similar to the first preferred embodiment as mentioned above with the exception described hereinafter. When the drawer 16 is pulled away from the furniture body 14 to a predetermined distance, the inner rod 88 of the buffer member 86 will extend outward to a predetermined position to engage with the holding member 50, as shown in FIG. 19. (The drawer 16 is not depicted in FIG. 19, please refer to FIG. 8.) Thus, when the drawer 16 is pushed backward into the furniture body 14, the buffer member 86 will provide a buffering force to the holding member 50 to slow down the movement.

While there has been described and illustrated some specific embodiments of the present invention, it will be clear that various in the details of the embodiment specifically illustrated and described may be made without departing from the true spirit and scope of the present invention as defined in the appended claims.

What is claimed is:

1. A retraction mechanism for a drawer, comprising at least one stationary rail, a furniture body, at least one drawer, and at least one drawer rail mounted to the drawer, the stationary rail being mounted to the furniture body and the drawer rail being slidably connected to the stationary rail, the retraction mechanism comprising:

a guiding member secured to the stationary rail, the guiding member comprising a first wall, a second wall, a third wall extending from the first wall, a first channel defined between the first wall and the third wall, a fourth wall extending from the second wall, a second channel defined between the second wall and the fourth wall, and a first end portion extending from first ends of the first wall and the second wall, the first end portion comprising a locking portion adjacent to the first channel;

a holding member comprising a first supporting portion holding against the first channel and a second supporting portion extending from the first supporting portion, the holding member clampingly engaging the guiding member between the first and second supporting portions, the first supporting portion comprising a first supporting leg corresponding to the locking portion of the guiding member, a second supporting leg, and a recess defined between the first supporting leg and the second supporting leg, the second supporting portion comprising a supporting plate holding against the fourth wall of the guiding member and a third supporting leg holding against the second channel of the guiding member, the recess providing a space for the holding member to tilt at a predetermined angle and the first supporting leg engaging with the locking portion of the guiding member, the holding member further comprising a first holding wall, a second holding wall, and a pin slot defined between the first holding wall and the second holding wall; and an elastic member having a first end connected to the holding member and a second end secured to the stationary rail, the elastic member providing a pulling force to the holding member;

the drawer comprising a pin corresponding in position to the pin slot, when the drawer is retracted into the furniture body, the pin of the drawer engaging with the pin slot of the holding member, the elastic member urging the holding member toward the second end of the elastic member, when the drawer is pulled outwardly to a first predetermined position, the pin holding against the first holding wall of the holding member for the holding member to tilt at an angle, the first supporting leg of the first supporting portion of the holding member disengaging from the first channel of the guiding member with the first supporting leg holding against the locking portion of the guiding member, the pin disengaging from the pin slot of the holding member, and the drawer being free from the elastic member;

when the drawer is moved towards the furniture body to a second predetermined position, the pin of the drawer holding against the second holding wall of the holding member for the holding member to tilt at an angle which brings the first supporting leg of the holding member to disengage from the locking portion of the guiding member, the holding member being pulled by the elastic member to retract the drawer into the furniture body.

2. The retraction mechanism for a drawer as claimed in claim 1, further comprising a second end portion extending from second ends of the first wall and the second wall, a first notch formed between the second end portion and the third wall, and a second notch formed between the second end portion and the fourth wall.

3. The retraction mechanism for a drawer as claimed in claim 1, wherein the first end portion of the guiding member comprises a first extension plate, a second extension plate extending inwardly from the first extension plate, and a clip slot defined between the first extension plate and the second extension plate, a head portion extending from one end of the holding member, the head portion corresponding in position to the clip slot of the guiding member.

4. The retraction mechanism for a drawer as claimed in claim 1, wherein the second channel is provided with a protrusion, the third supporting leg of the second supporting portion holding against the protrusion when the holding member is moved to the first predetermined position.

5. The retraction mechanism for a drawer as claimed in claim 3, wherein a buffer slot is formed between the head portion and the holding member, the head portion having an inclined plane corresponding to the second extension plate and a stop surface adjacent to the inclined plane to form an acute angle thereat.

6. The retraction mechanism for a drawer as claimed in claim 1, further comprising a side wall between the first wall and the second wall and a groove defined among the side wall, the first wall and the second wall, the holding member comprising a holding portion resting in the groove.

7. The retraction mechanism for a drawer as claimed in claim 1, further comprising a first connecting seat provided at the holding member for connecting with the first end of the elastic member.

8. The retraction mechanism for a drawer as claimed in claim 7, further comprising a connecting member connected to the first connecting seat, the connecting member comprising a pair of connecting portions for connecting with first ends of a pair of elastic members, second ends of the pair of elastic members being secured to the stationary rail.

9. The retraction mechanism for a drawer as claimed in claim 1, further comprising a first connecting seat and a second connecting seat provided at the holding member for connecting with a connecting member and a pad, the connecting member comprising a pair of connecting portions for connecting with a pair of elastic members, the pad corresponding in position to a buffer member, the buffer member having a first end secured to the stationary rail and a second end provided with a telescopic inner rod to hold against the pad for providing a buffering force to the holding member.

10. A refraction mechanism for a drawer, comprising at least one stationary rail, a furniture body, at least one drawer, and at least one drawer rail mounted to the drawer, the stationary rail being mounted to the furniture body and the drawer rail being slidably connected to the stationary rail, the retraction mechanism comprising:

a guiding member secured to the stationary rail, the guiding member comprising a first wall, a second wall, a third wall extending from the first wall, a first channel defined between the first wall and the third wall, a fourth wall extending from the second wall, a second channel defined between the second wall and the fourth wall, and a first end portion extending from first ends of the first wall and the second wall, the first end portion comprising a locking portion adjacent to the first channel;

a holding member comprising a first supporting portion holding against the first channel and a second supporting portion extending from the first supporting portion, the holding member clampingly engaging the guiding member between the first and second supporting portions, the first supporting portion comprising a first supporting leg corresponding to the locking portion of the guiding member, a second supporting leg, and a recess defined between the first supporting leg and the second supporting leg, the second supporting portion comprising a supporting plate holding against the fourth wall of the guiding member and a third supporting leg holding against the second channel of the guiding member, the recess providing a space for the holding member to tilt at a predetermined angle and the first supporting leg engaging with the locking portion of the guiding member, the holding member further comprising a first holding wall, a second holding wall, and a pin slot defined between the first holding wall and the second holding wall, the drawer comprising a pin corresponding in position to the pin slot, the first holding wall and the second holding wall being substantially perpendicular to the first wall of the guiding member, a length from a top of the first holding wall to a bottom of the pin slot being shorter than a length from a bottom of the first supporting leg to a top of the recess; and an elastic member having a first end connected to the holding member and a second end secured to the stationary rail, the elastic member providing a pulling force to the holding member.

11. The retraction mechanism for a drawer as claimed in claim 10, further comprising a second end portion extending from second ends of the first wall and the second wall, a first notch formed between the second end portion and the third wall, and a second notch formed between the second end portion and the fourth wall.

12. The retraction mechanism for a drawer as claimed in claim 10, wherein the first end portion of the guiding member comprises a first extension plate, a second extension plate extending inwardly from the first extension plate, and a clip slot defined between the first extension plate and the second extension plate, a head portion extending from one end of the holding member, the head portion corresponding in position to the clip slot of the guiding member.

13. The retraction mechanism for a drawer as claimed in claim 10, wherein the second channel is provided with a protrusion, the third supporting leg of the second supporting portion holding against the protrusion when the holding member is moved to a predetermined position.

14. The retraction mechanism for a drawer as claimed in claim 12, wherein a buffer slot is formed between the head portion and the holding member, the head portion having an inclined plane corresponding to the second extension plate and a stop surface adjacent to the inclined plane to form an acute angle thereat.

15. The retraction mechanism for a drawer as claimed in claim 10, further comprising a side wall between the first wall and the second wall and a groove defined among the side wall, the first wall and the second wall, the holding member comprising a holding portion resting in the groove.

16. The retraction mechanism for a drawer as claimed in claim 10, further comprising a first connecting seat provided at the holding member for connecting with the first end of the elastic member.

17. The retraction mechanism for a drawer as claimed in claim 16, further comprising a connecting member connected to the first connecting seat, the connecting member comprising a pair of connecting portions for connecting with first ends of a pair of elastic members, second ends of the pair of elastic members being secured to the stationary rail.

18. The retraction mechanism for a drawer as claimed in claim 10, further comprising a first connecting seat and a second connecting seat provided at the holding member for connecting with a connecting member and a pad, the connecting member comprising a pair of connecting portions for connecting with a pair of elastic members, the pad corresponding in position to a buffer member, the buffer member having a first end secured to the stationary rail and a second end provided with a telescopic inner rod to hold against the pad for providing a buffering force to the holding member.

19. A refraction mechanism, comprising:

a guiding member comprising a first wall, a second wall, a third wall extending from the first wall, a first channel defined between the first wall and the third wall, a fourth wall extending from the second wall, a second channel defined between the second wall and the fourth wall, and a first end portion extending from first ends of the first wall and the second wall, the first end portion comprising a locking portion adjacent to the first channel;

a holding member comprising a first supporting portion holding against the first channel and a second supporting portion extending from the first supporting portion, the holding member clampingly engaging the guiding member between the first and second supporting portions, the first supporting portion comprising a first supporting leg corresponding to the locking portion of the guiding member, a second supporting leg, and a recess defined between the first supporting leg and the second supporting leg, the second supporting portion comprising a supporting plate holding against the fourth wall of the guiding member and a third supporting leg holding against the second channel of the guiding member, the recess providing a space for the holding member to tilt at a predetermined angle and the first supporting leg engaging with the locking portion of the guiding member, the holding member further comprising a first holding wall, a second holding wall, and a pin slot defined between the first holding wall and the second holding wall, the first holding wall and the second holding wall being substantially perpendicular to the first wall of the guiding member, a length from a top of the first holding wall to a bottom of the pin slot being shorter than a length from a bottom of the first supporting leg to a top of the recess; and an elastic member having a first end connected to the holding member for the elastic member providing a pulling force to the holding member.

20. The retraction mechanism as claimed in claim 19, further comprising a second end portion extending from second ends of the first wall and the second wall, a first notch formed between the second end portion and the third wall, and a second notch formed between the second end portion and the fourth wall.

21. The retraction mechanism as claimed in claim 19, wherein the first end portion of the guiding member comprises a first extension plate, a second extension plate extending inwardly from the first extension plate, and a clip slot defined between the first extension plate and the second extension plate, a head portion extending from one end of the holding member, the head portion corresponding in position to the clip slot of the guiding member.

22. The retraction mechanism as claimed in claim 19, wherein the second channel is provided with a protrusion, the third supporting leg of the second supporting portion holding against the protrusion when the holding member is moved to a predetermined position.

23. The retraction mechanism as claimed in claim 21, wherein a buffer slot is formed between the head portion and the holding member, the head portion having an inclined plane corresponding to the second extension plate and a stop surface adjacent to the inclined plane to form an acute angle thereat.

24. The retraction mechanism as claimed in claim 19, further comprising a side wall between the first wall and the second wall and a groove defined among the side wall, the first wall and the second wall, the holding member comprising a holding portion resting in the groove.

25. The retraction mechanism as claimed in claim 19, further comprising a first connecting seat provided at the holding member for connecting with the first end of the elastic member.

26. The retraction mechanism as claimed in claim 25, further comprising a connecting member connected to the first connecting seat, the connecting member comprising a pair of connecting portions for connecting with first ends of a pair of elastic members.

27. The retraction mechanism as claimed in claim 19, further comprising a first connecting seat and a second connecting seat provided at the holding member for connecting with a connecting member and a pad, the connecting member comprising a pair of connecting portions for connecting with a pair of elastic members, the pad corresponding in position to a buffer member, the buffer member comprising a telescopic inner rod to hold against the pad for providing a buffering force to the holding member.

* * * * *